US009874392B2

(12) United States Patent
Kempfle

(10) Patent No.: US 9,874,392 B2
(45) Date of Patent: Jan. 23, 2018

(54) REFRIGERATION APPLIANCE WITH DOOR-OPENING AID

(71) Applicant: BSH HAUSGERAETE GMBH, Munich (DE)

(72) Inventor: Stephan Kempfle, Ellzee (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/037,057

(22) PCT Filed: Nov. 6, 2014

(86) PCT No.: PCT/EP2014/073949

§ 371 (c)(1),
(2) Date: May 17, 2016

(87) PCT Pub. No.: WO2015/074890

PCT Pub. Date: May 28, 2015

(65) Prior Publication Data

US 2016/0281408 A1 Sep. 29, 2016

(30) Foreign Application Priority Data

Nov. 20, 2013 (DE) ..... 10 2013 223 728

(51) Int. Cl.

| | |
|---|---|
| ***E05F 15/18*** | (2006.01) |
| ***F25D 23/02*** | (2006.01) |
| ***E05B 17/00*** | (2006.01) |
| ***E05F 15/616*** | (2015.01) |
| ***E06B 3/36*** | (2006.01) |
| ***F25D 23/06*** | (2006.01) |

(52) U.S. Cl.
CPC ..... *F25D 23/028* (2013.01); *E05B 17/0029* (2013.01); *E05B 17/0033* (2013.01); *E05F 15/616* (2015.01); *E06B 3/36* (2013.01); *F25D 23/065* (2013.01); *E05Y 2201/434* (2013.01); *E05Y 2900/31* (2013.01)

(58) Field of Classification Search
CPC .... E05F 15/616; F25D 23/065; F25D 23/028; E06B 3/36; E05Y 2900/31
USPC ..... 49/276; 312/401, 405
See application file for complete search history.

(56) References Cited

U.S. PATENT DOCUMENTS 3,012,837 A * 12/1961 Morrissey, Jr. ..... E05B 17/0033 49/276
6,338,536 B1 1/2002 Ueno et al.
(Continued)

FOREIGN PATENT DOCUMENTS

DE 102010020626 A1 11/2011
EP 1077354 A2 2/2001
(Continued)

*Primary Examiner* — Katherine W Mitchell
*Assistant Examiner* — Abe Massad
(74) *Attorney, Agent, or Firm* — Laurence A. Greenberg; Werner H. Stemer; Ralph E. Locher

(57) ABSTRACT

A refrigeration appliance, in particular a household refrigeration appliance, has a body and a door leaf which is hinged to the body and delimits a storage compartment. At least one door-opening aid is mounted on the body and includes a pusher element that can move between a rest position and an active position. A drive mechanism for the door-opening aid is housed in a machine compartment in the body.

14 Claims, 2 Drawing Sheets

(56) References Cited

U.S. PATENT DOCUMENTS

| | | | | |
|---|---|---|---|---|
| 6,811,236 | B1 * | 11/2004 | Spong | E05C 19/166 312/222 |
| 6,845,545 | B2 * | 1/2005 | Han | E05F 1/1269 16/277 |
| 8,297,725 | B2 * | 10/2012 | Kim | F25D 23/028 312/319.7 |
| 8,454,102 | B2 * | 6/2013 | Kim | E05F 15/619 312/319.5 |
| 8,469,469 | B2 * | 6/2013 | Kim | E05B 17/0029 312/319.5 |
| 2009/0031634 | A1 * | 2/2009 | Glanz | E05D 5/12 49/324 |
| 2014/0306596 | A1 * | 10/2014 | Linke | E05F 15/611 312/405 |

FOREIGN PATENT DOCUMENTS

| | | | |
|---|---|---|---|
| JP | 2002295968 | A | 10/2002 |
| JP | 2002350043 | A | 12/2002 |
| JP | 2006118767 | A | 5/2006 |

* cited by examiner

REFRIGERATION APPLIANCE WITH DOOR-OPENING AID

BACKGROUND OF THE INVENTION

Field of the Invention

The present invention relates to a refrigeration appliance, in particular a domestic refrigeration appliance, with a door-opening aid, as known for example from DE 10 2010 020 626 A1.

In such a conventional built-in appliance a door-opening aid is mounted on an outer face of the body and comprises a movable pusher element, which pushes against a furniture panel suspended on the door leaf on the path from a rest position to an active position, thus moving the door into a partially open position, from which a user can open the door further with little force expenditure.

A drive mechanism for the pusher element is mounted on an outer face of the body. If space has to be found for such a drive mechanism in a built-in refrigeration appliance between an outer wall of its body and a wall of the recess, the usable volume of the refrigeration appliance is significantly restricted. It is also much more difficult to position a free-standing appliance as a result of an isolated drive mechanism projecting from an outer face of the body. However it is also not possible simply to lower the drive mechanism into the heat-insulating insulation layer of the body without creating a cold bridge to the storage compartment there.

BRIEF SUMMARY OF THE INVENTION

It is therefore the object of the present invention to create a refrigeration appliance with door-opening aid, in which a drive mechanism of the door-opening aid does not project beyond an outer face of the body or significantly restrict the usable volume of the storage compartment.

This object is achieved in that, in a refrigeration appliance, in particular a domestic refrigeration appliance, with a body and a door leaf hinged to the body, which delimit a storage compartment, and with at least one door-opening aid arranged on the body and having a pusher element that can be moved between a rest position and an active position, a drive mechanism of the door-opening aid is housed in a machine compartment of the body. As such a machine compartment generally still has free space between the components of a refrigeration machine conventionally contained in it, such as the compressor, condenser, etc., there will frequently also be space for the drive mechanism here without having to enlarge the machine compartment at the expense of the storage area and without a heat bridge being created between the chilled storage area and the environment.

The distance between the drive mechanism and the pusher element, which is generally mounted on a front face of the body, can be bridged by an arm. Said arm is preferably passed through a tube.

A front end of the tube can be arranged centrally between two side walls of the body so that the pusher element can engage with the door leaf with the same lever arm length regardless of the side on which said door leaf is hinged.

The tube can however also run along a first side wall of the body in order to allow the pusher element to engage with the door leaf at a distance from a pivot axis.

A second tube can run along a second side wall opposite the first side wall in order to be able to receive the arm if the hinge side of the door is changed.

The tube can be embedded into a thermal insulation layer of the body. However it can also run along an outer wall of the body, outside a thermal insulation layer of the same.

The pusher element can be moved by the drive mechanism preferably between a rest position and an active position, pushing against an edge region of the door leaf on the path from the rest position to the active position and thus opening the door at least so far that it can be opened further by hand with little force expenditure.

The door leaf preferably comprises a base body provided with a thermally insulating filling in the known manner. A pressure plate projecting in the direction of a pivot axis of the door leaf can be joined to this in order to form the edge region against which the pusher element pushes. Such a multi-part door leaf structure on the one hand allows already existing refrigeration appliance door leaves to be used as the base plate. Also because of its small dimensions the pressure plate can be manufactured from a high quality durable material at low cost or it can be replaced when the signs of wear become too obvious.

The pusher element can be arranged in a space-saving manner level with a hinge element connecting the door leaf to the body.

The drive mechanism can comprise an electric drive, in particular an electric motor.

A rotary drive, for example an electric motor, is preferably arranged on a side of the machine compartment away from the door to allow sufficient space between it and a front wall of the machine compartment for the conversion of the rotational movement of the electric motor to a to and fro movement of the arm.

For such conversion the drive mechanism can comprise in particular a piston rod that extends through the machine compartment.

BRIEF DESCRIPTION OF THE SEVERAL VIEWS OF THE DRAWING

Further features and advantages of the invention will emerge from the description that follows of exemplary embodiments with reference to the accompanying figures, in which.

DESCRIPTION OF THE INVENTION

Figure 1:
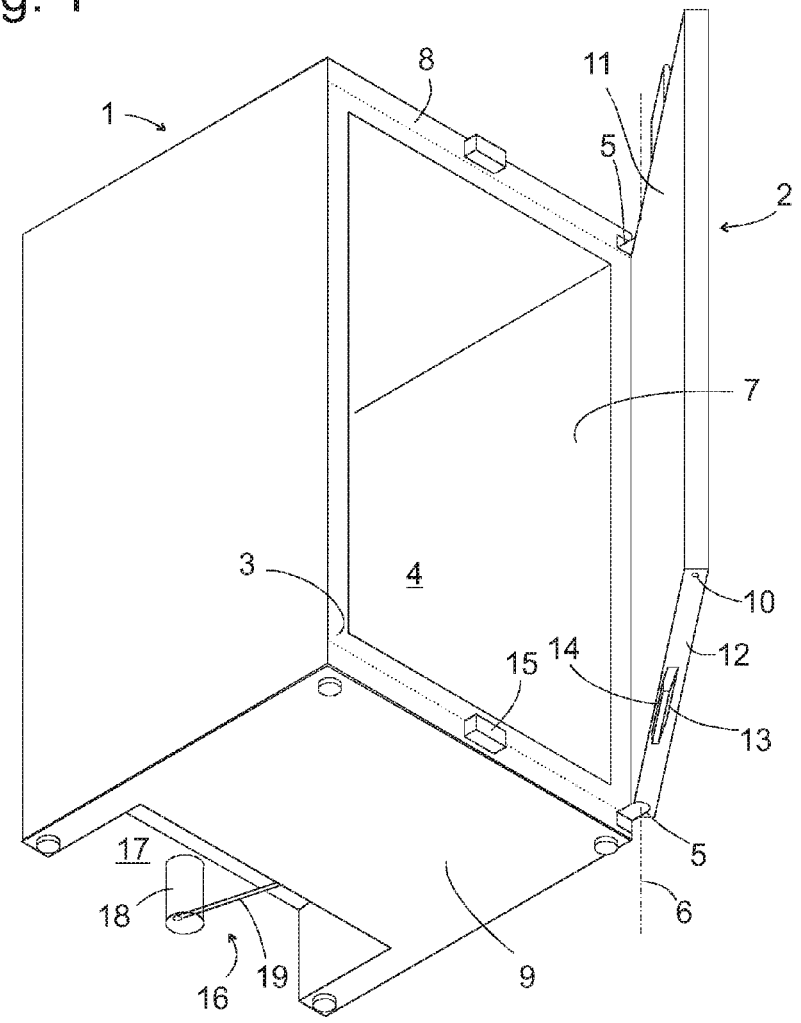
FIG. 1 shows a perspective view of a refrigeration appliance according to a first embodiment of the invention.

FIG. 1 shows an oblique perspective view from below of the housing of a domestic refrigeration appliance, which can be either a free-standing appliance or a built-in appliance. In the usual manner the housing comprises a body 1 and a door leaf 2, which is hinged to the body 1 in a pivotable manner and in the closed position rests against a front frame 3 of the body in an almost air-tight manner. This almost air-tight connection means that when warm air passes through the open door 2 into a storage space 4 in the body and cools there, a reduced pressure results, which presses the door 2 against the front frame 3 with great force, making it difficult to open the door 2 again, until the pressure difference between storage space 4 and environment is fully equalized.

Also large-scale magnetic attraction between a magnetic seal (not shown here) on the door 2 and the front frame 3 can make it difficult to open the door 2 by hand.

Hinge elements 5, which hold the door 2 so that it can be pivoted about an axis 6, are fastened here at upper and lower ends of a right side wall 7 of the body 1, level with a top or base plate 8, 9, and engage in bearing bushes (not visible) of the door 2. Corresponding bearing bushes 10 are also provided in a mirror image on a left edge of the door leaf 2 in order also to be able to mount the door leaf 2, if desired, with a pivot axis running along its left edge.

The door leaf 2 comprises a flat cuboidal base body 11 of a structure known per se, with a fixed outer skin made of sheet metal or plastic and a filling of thermally insulating rigid foam. The bearing bushes 10 engage in upper and lower narrow faces 12 of the base body 11. A pressure plate 13 is fastened to the center of the lower narrow face 12 and projects downward. The pressure plate 13 can be an injection molded part made of plastic, optionally with a metallic layer on a stop face 14 facing the front frame 3.

On the frame 3 opposite the stop face 14 is a pusher element 15 that can be moved in the depth wise direction of the body 1. The pusher element 15 can be moved between a rest position, in which it is at a distance from the pressure plate 13 when the door leaf 2 is in the closed position, and an active position, in which it pushes against the pressure plate 13 and keeps the door leaf 2 away from the frame 3. The movement of the pusher element 15 is driven by a drive mechanism 16, which is housed in a machine compartment 17 on the rear face of the body 1. The machine compartment 17 also contains components of a refrigeration machine that are known per se and are therefore not shown in the figure, such as a compressor, condenser, etc. The drive mechanism 16 comprises an electric motor 18 and a piston rod hinged eccentrically to the electric motor 18, preferably by way of a reduction gear unit. An arm concealed in the interior of the base plate 9 in FIG. 1 connects the front end of the piston rod 19 to the pusher element 15.

Figure 2:
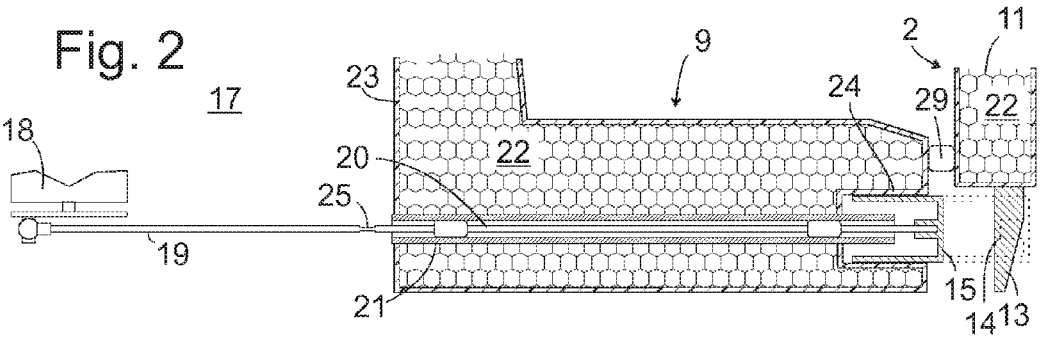
FIG. 2 shows a section in the depth wise direction through the base region of the body of the refrigeration appliance from FIG. 1.

According to the section through the base plate 9 shown in FIG. 2 the arm, marked 20 here, is passed through a tube 21, which is embedded into the thermal insulation material 22 of the body 1 and extends between a front wall 23 of the machine compartment 17 and an indentation 24 in the front frame 3, which receives the pusher element 15. The arm 20 is configured as a single piece with the piston rod 19 here and a tapering 25 between the two ensures the necessary pivoting movement between the arm 20, which passes in a linear manner through the tube 21 in the depth wise direction of the body 1, and the piston rod 19, the rear end of which is driven by the electric motor 18 to execute a pendulum movement in the widthwise direction of the body at the arm.

FIG. 2 shows the piston rod 19 at a rear turning point of its movement. Beyond the rest position shown here it cannot pull the pusher element 15 back into the indentation 24. An active position, in which the pusher element is moved to the maximum distance out of the indentation 24, is shown with a broken line. Before the pusher element can reach this position, it pushes against the pressure plate 13, thereby pushing the door leaf 2 out of the illustrated position, in which its magnetic seal 29 rests tightly against the front frame 3, into a partially open position, in which magnetic seal 29 and front frame 3 are separated by an air gap.

Figure 3:
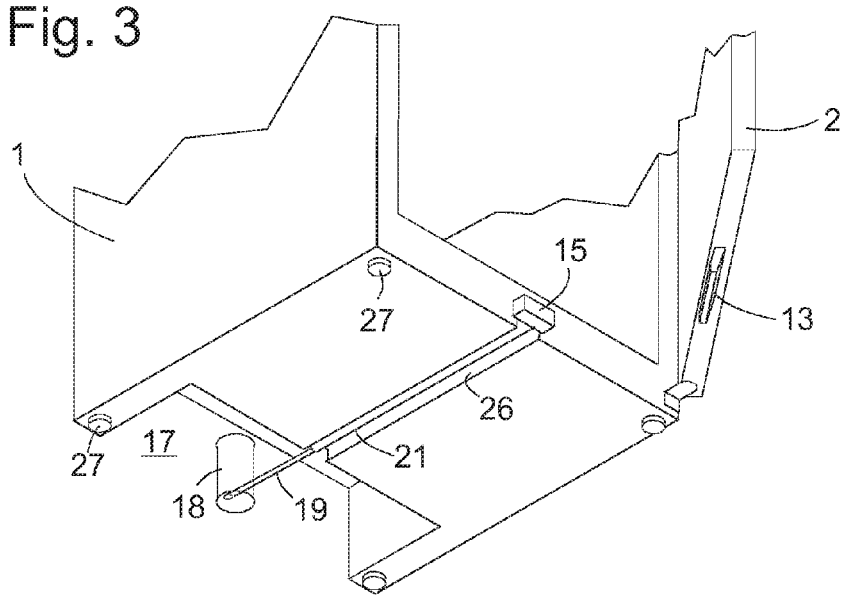
FIG. 3 shows a perspective partial view of a refrigeration appliance according to a second embodiment of the invention.

FIG. 3 shows a partial view of the refrigeration appliance housing illustrating a change to the embodiment in FIGS. 1 and 2. The tube 21 is not embedded into the thermal insulation material 22 here but runs in a cutout 26 in the base plate 9 which is open at the bottom. There is therefore no need to seal the ends of the tube 21 to prevent the passage of the thermal insulation material 22 during foaming.

Figure 4:
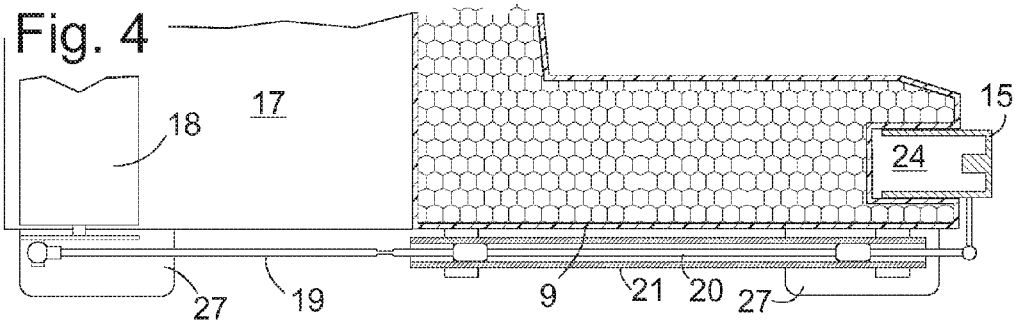
FIG. 4 shows a view similar to FIG. 3 of a third embodiment of the invention.

FIG. 4 shows a simplified variant in a section similar to the one in FIG. 2. The lower face of the base plate 9 here is smooth and the tube 21 runs below the base plate 9 in a space between the base plate and a support (not shown), on which the body is positioned, kept free by feet 27 of the body 1.

Figure 5:
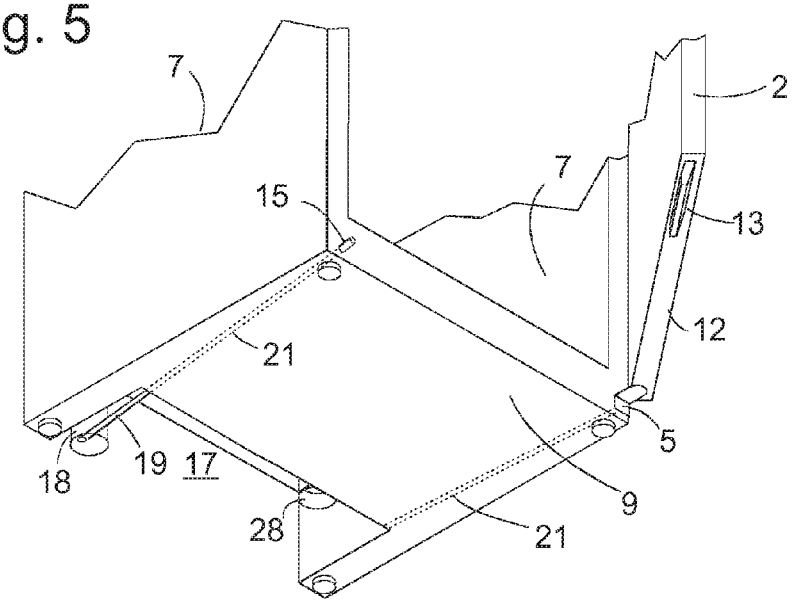
FIG. 5 shows a perspective partial view according to a fourth embodiment of the invention.

Again in a perspective view similar to the one in FIG. 3, FIG. 5 shows a variant in which two tubes 21 extend along both side walls 7 of the body 1. In the embodiment illustrated here the tubes 21 run within the base plate 9, as shown in FIGS. 1 and 2, but it goes without saying that the tubes 21 could also run outside the thermal insulation material 22, in a cutout in the base plate 9 or, at least in a rear region, below the base plate 9.

Positioned in the machine compartment 17 are two holders 28, of which the one adjacent to the left side wall 7 holds the electric motor 18 of the drive mechanism 16, while the other holder 28, which is the only one visible in the figure, is empty. The piston rod 19 here drives an arm extending through the left tube 21, the tip of said arm forming the pusher element 15 projecting from an opening in the frame 3. A corresponding opening at the front end of the right tube 21 is covered by the lower hinge element 5 mounted in front of it.

A pressure plate 13 projecting downward from the lower narrow face 12 of the door leaf base body 11 is arranged here on the end of the narrow face away from the hinge to interact with the pusher element 15.

The pressure plate 13 can be removed and can be replaced or mounted on the opposite end of the lower narrow face 12 of the base body 11 if required, instead of the hinge element 5 shown there in FIG. 5, and the hinge element 5 can be moved to the left side wall 7, in front of the end of the left tube 21. The opening of the door can be assisted effectively even after the door has been hinged on the other side in that the electric motor 18 is moved to the opposite holder 28 and the arm is inserted into the right tube 21.

LIST OF REFERENCE CHARACTERS

1 Body
2 Door
3 Frame 3
4 Storage space
5 Hinge elements
6 Axis
7 Side wall
8 Base plate
9 Base plate
10 Bearing bushes
11 Base body
12 Lower narrow face
13 Pressure plate
14 Stop face
15 Pusher element
16 Drive mechanism
17 Machine compartment
18 Electric motor
19 Piston rod

20 Arm
21 Tube
22 Thermal insulation material
23 Wall
24 Indentation
25 Tapering
26 Cutout
27 Feet
28 Holders
29 Magnetic seal

The invention claimed is:

1. A refrigeration appliance or domestic refrigeration appliance, comprising:

a body having a front face;

a door leaf hinged to said body at said front face, said body and said door leaf delimiting a storage compartment;

said body having a machine compartment being disposed at a rear bottom position of said body, said machine compartment having a front wall spaced apart from said front face and delimiting said machine compartment on a side of said machine compartment towards said front face; and at least one door-opening aid disposed on said body, said at least one door-opening aid having a pusher element being movable between a rest position and an active position and said at least one door-opening aid having a drive mechanism housed in said machine compartment;

said drive mechanism including an electric motor defining a rotary drive disposed in said machine compartment on a side of said machine compartment facing away from said door leaf.

2. The refrigeration appliance according to claim 1, wherein said body has a front frame, said pusher element is disposed on said front frame, and an arm connects said pusher element to said drive mechanism.

3. The refrigeration appliance according to claim 2, which further comprises a tube, said arm passing through said tube.

4. The refrigeration appliance according to claim 3, wherein said body has two side walls, and said tube has a front end disposed centrally between said two side walls.

5. The refrigeration appliance according to claim 3, wherein said body has first and second mutually opposite side walls, and said tube is a first tube running along said first side wall.

6. The refrigeration appliance according to claim 5, which further comprises a second tube running along said second side wall.

7. The refrigeration appliance according to claim 3, wherein said body has a thermal insulation layer, and said tube is embedded into said thermal insulation layer.

8. The refrigeration appliance according to claim 3, wherein said body has a thermal insulation layer, and said tube runs outside said thermal insulation layer.

9. The refrigeration appliance according to claim 2, wherein said door leaf has an edge region, said pusher element is movable by said drive mechanism between said rest position and said active position and said pusher element pushes against said edge region on a path from said rest position to said active position.

10. The refrigeration appliance according to claim 9, wherein said door leaf includes:

a base body provided with a thermally insulating filling;

a pivot axis defining a direction; and a pressure plate forming said edge region against which said pusher element pushes, said pressure plate projecting along said direction defined by said pivot axis and said pressure plate being joined to said base body.

11. The refrigeration appliance according to claim 10, which further comprises a hinge element connecting said door leaf to said body, said pusher element being disposed level with said hinge element.

12. The refrigeration appliance according to claim 1, wherein said body has a front frame, and an arm extends from said front wall towards said front face to connect said pusher element to said drive mechanism.

13. A refrigeration appliance or domestic refrigeration appliance, comprising:

a body having a front face and a rear face opposite said front face;

insulating material disposed between said front face and said rear face;

a door leaf hinged to said body at said front face, said body and said door leaf delimiting a storage compartment;

said body having a machine compartment; and at least one door-opening aid disposed on said body, said at least one door-opening aid having a pusher element being movable between a rest position and an active position and said at least one door-opening aid having a drive mechanism housed in said machine compartment;

said drive mechanism including an electric motor defining a rotary drive disposed in said machine compartment on a side of said machine compartment facing away from said door leaf;

a tube disposed in said insulating material, said tube extending from said machine compartment to said front face and serving as an activation channel for said pusher element.

14. The refrigeration appliance according to claim 13, further comprising an arm disposed in said tube, said arm connecting said pusher element to said drive mechanism.

* * * * *